US008733227B1

(12) United States Patent
Ridgeway et al.

(10) Patent No.: US 8,733,227 B1
(45) Date of Patent: May 27, 2014

(54) STAND MOUNTABLE WEAPON SUPPORT ASSEMBLY

(76) Inventors: Travis Ridgeway, West Frankfort, IL (US); Danny Ridgeway, West Frankfort, IL (US)

( * ) Notice: Subject to any disclaimer, the term of this patent is extended or adjusted under 35 U.S.C. 154(b) by 7 days.

(21) Appl. No.: 13/598,690

(22) Filed: Aug. 30, 2012

(51) Int. Cl.
*F41A 23/00* (2006.01)
*F41C 27/00* (2006.01)

(52) U.S. Cl.
USPC ..... 89/37.13; 89/37.04; 248/176.3; 248/166

(58) Field of Classification Search
USPC ..... 89/37.04, 37.13; 42/94; 124/44.5; 248/188.6, 166, 176.3, 226.11, 204
See application file for complete search history.

(56) References Cited

U.S. PATENT DOCUMENTS 4,696,461 A * 9/1987 Zelinski ..... 269/16
4,729,363 A 3/1988 Skyba
4,936,415 A 6/1990 Williams
5,465,933 A 11/1995 Todd
D375,644 S 11/1996 Foster et al.
5,685,104 A 11/1997 Breazeale, Jr.
6,305,117 B1 * 10/2001 Hales, Sr. ..... 42/94
6,457,685 B1 * 10/2002 Taylor ..... 248/166
6,663,059 B1 * 12/2003 Warren ..... 248/156
7,021,423 B1 4/2006 Pestrue et al.
7,930,852 B1 4/2011 Hubbard, Jr.
2010/0251592 A1 10/2010 Otto

* cited by examiner

*Primary Examiner* — Bret Hayes
*Assistant Examiner* — Joshua Freeman

(57) ABSTRACT

A stand mountable weapon support assembly includes a base and a bracket attached to the base. The bracket couples the base to a tree stand. A post has a first end and a second end. The first end is pivotally coupled to the base and the post is positionable between a deployed position extending upwardly from the base or in a stored position lying on the base. A gun holder is attached to the post adjacent to the second end. A gun is supportable by the base and the post in an upright position.

10 Claims, 4 Drawing Sheets

STAND MOUNTABLE WEAPON SUPPORT ASSEMBLY

BACKGROUND OF THE DISCLOSURE

Field of the Disclosure

The disclosure relates to hunting weapon support devices and more particularly pertains to a new hunting weapon support device for supporting a hunting weapon in an upright position adjacent to tree hunting stand.

SUMMARY OF THE DISCLOSURE

An embodiment of the disclosure meets the needs presented above by generally comprising a base and a bracket attached to the base. The bracket is configured to couple the base to a tree stand. A post has a first end and a second end. The first end is pivotally coupled to the base and the post is positionable between a deployed position extending upwardly from the base or in a stored position lying on the base. A gun holder is attached to the post adjacent to the second end. A gun is supportable by the base and the post in an upright position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
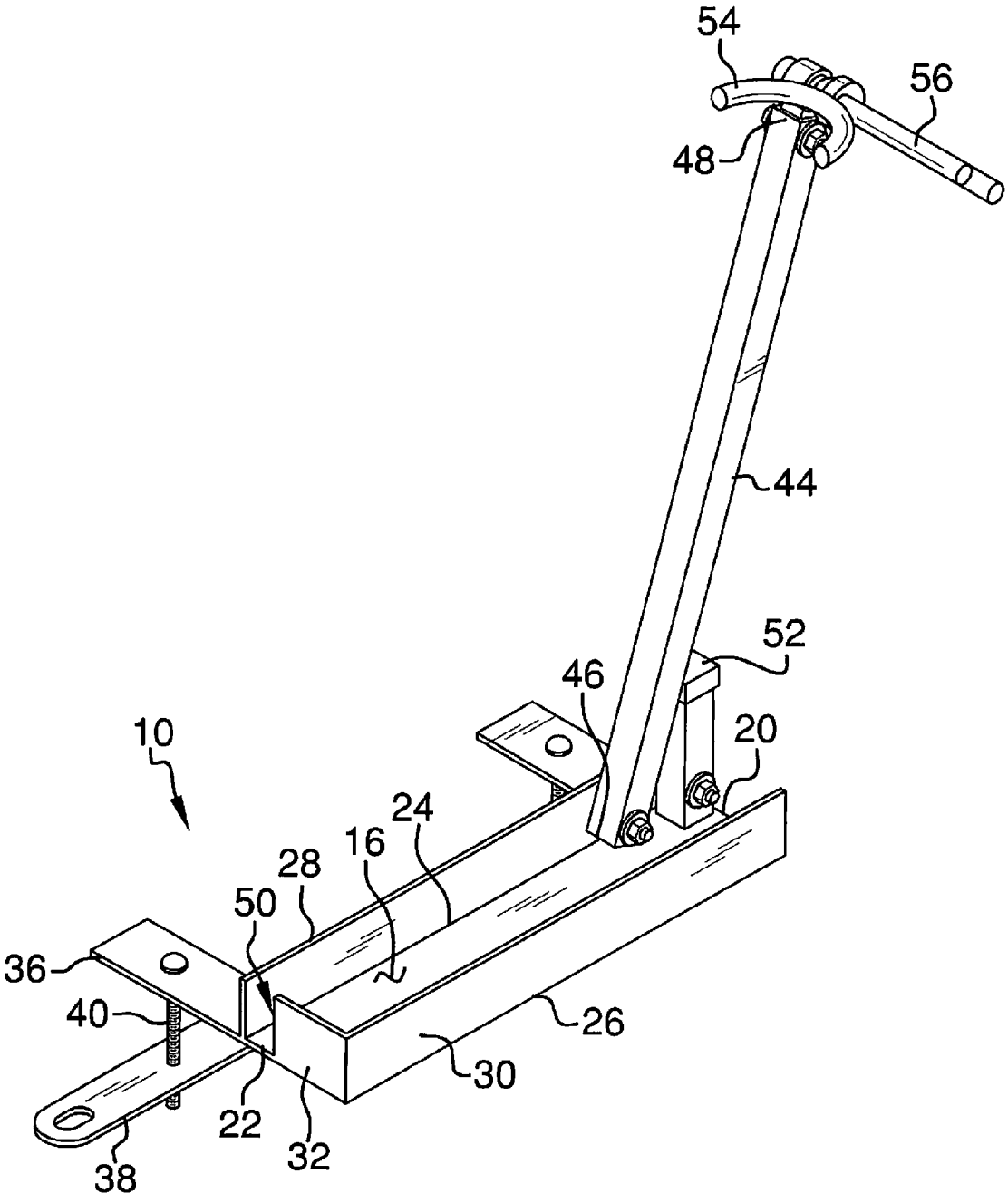
FIG. 1 is a rear perspective view of a stand mountable weapon support assembly according to an embodiment of the disclosure.
Figure 2:
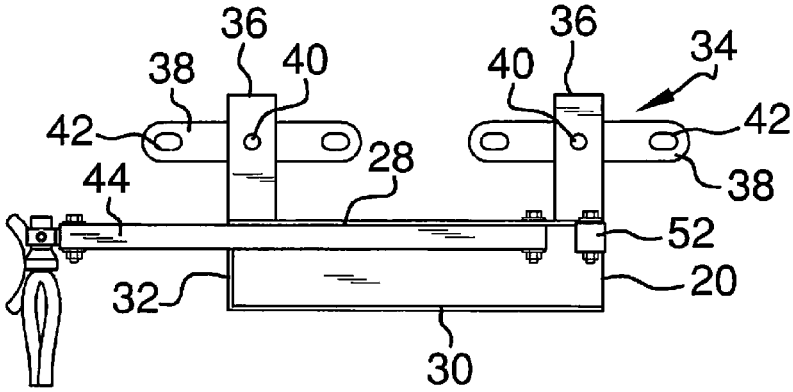
FIG. 2 is a top view of an embodiment of the disclosure in a stored position.
Figure 3:
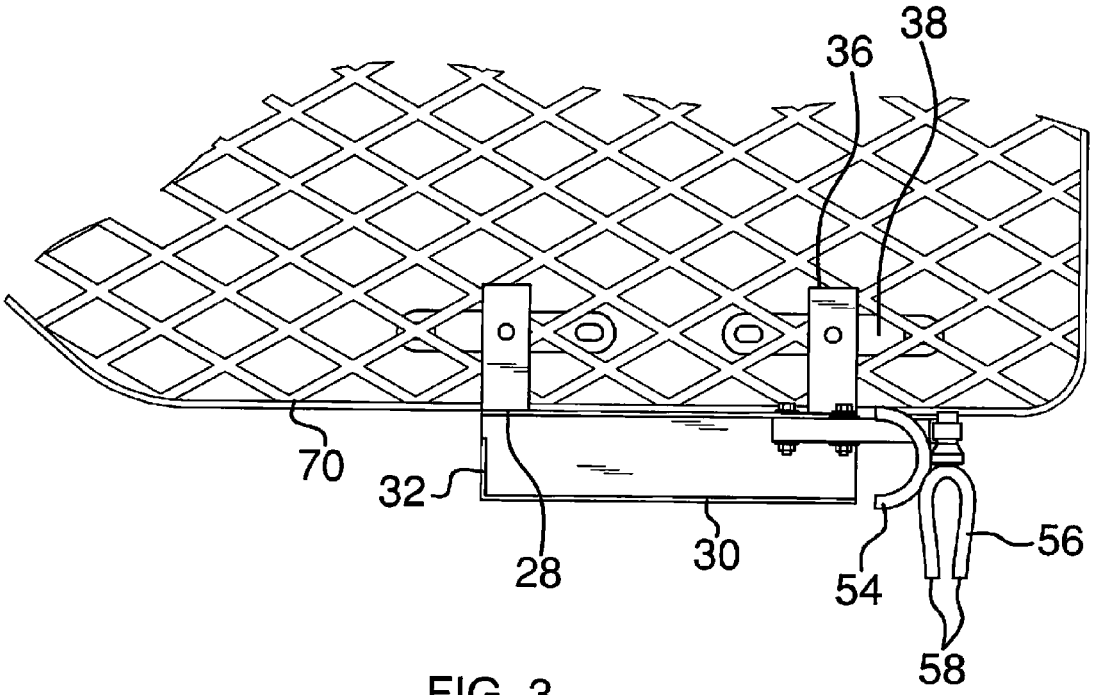
FIG. 3 is a top view of an embodiment of the disclosure in a deployed position.
Figure 4:
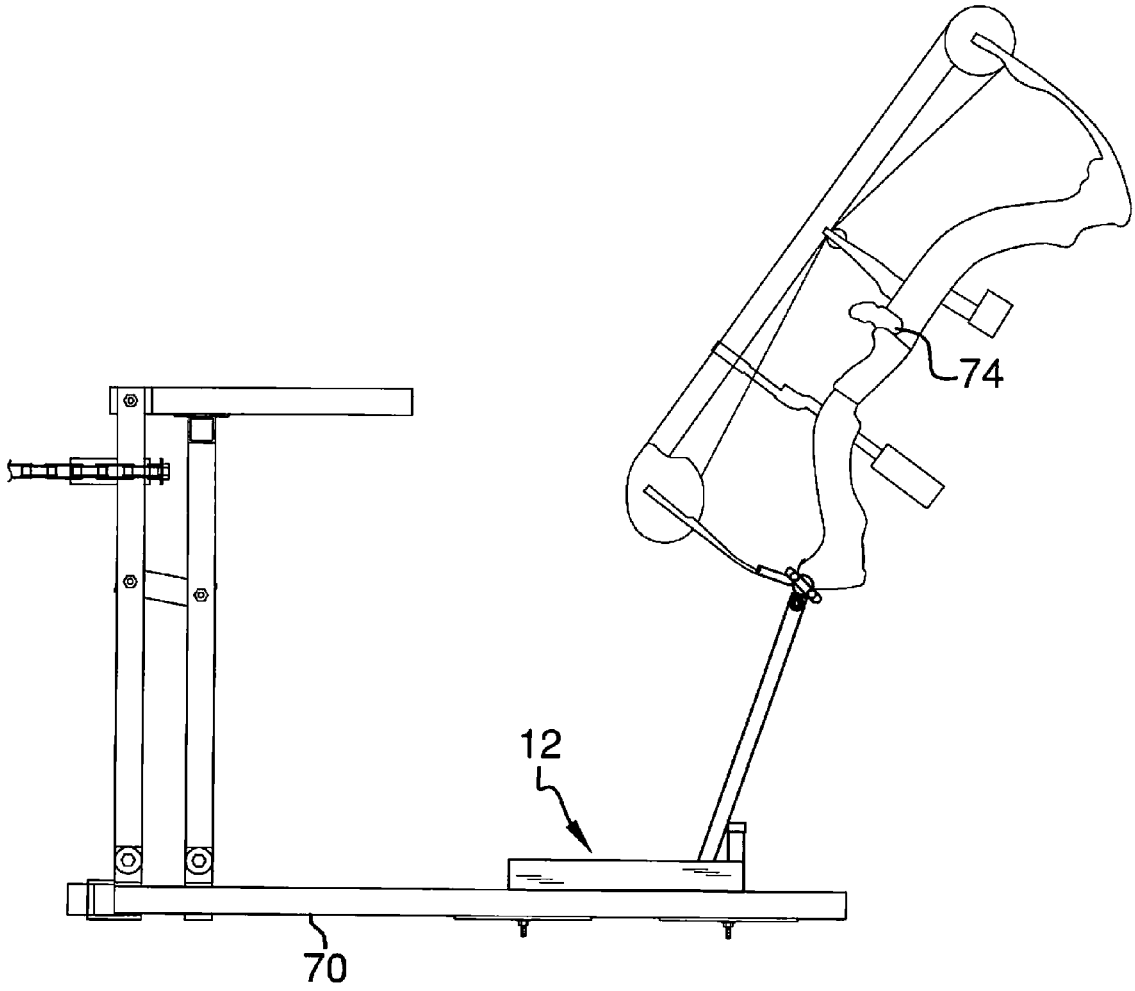
FIG. 4 is a side view of an embodiment of the disclosure.
Figure 5:
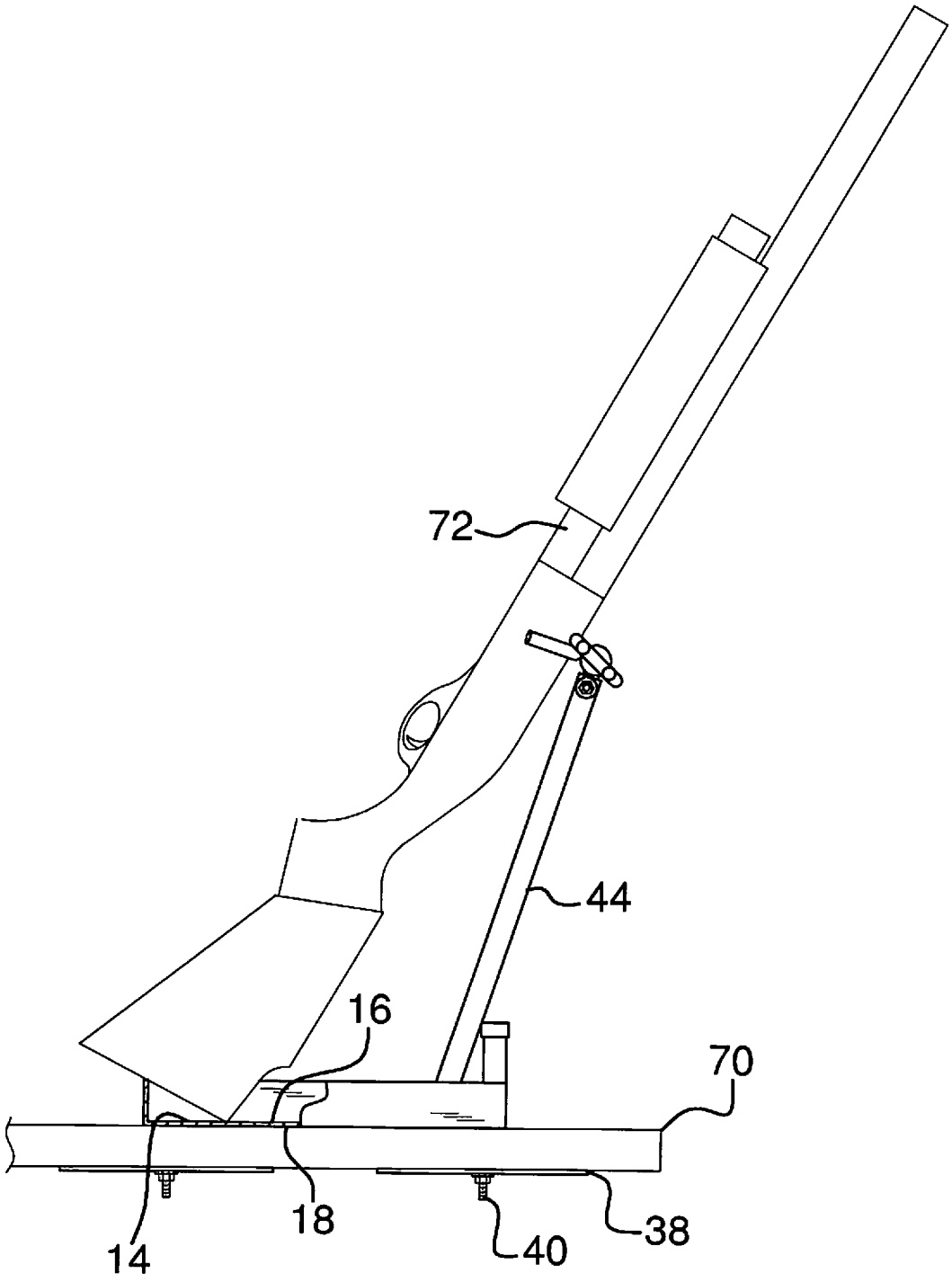
FIG. 5 is a side view of an embodiment of the disclosure.

With reference now to the drawings, and in particular to FIGS. 1 through 5 thereof, a new hunting weapon support device embodying the principles and concepts of an embodiment of the disclosure and generally designated by the reference numeral 10 will be described.

As best illustrated in FIGS. 1 through 5, the stand mountable weapon support assembly 10 generally comprises a base 12 comprising a rigid material such a plastic, wood or metallic material. The base 12 includes a plate 14 having a top side 16, a bottom side 18, a front edge 20, a rear edge 22, a first lateral edge 24 and a second lateral edge 26. The plate 14 may be elongated from the front edge 20 to the rear edge 22. A first side wall 28 is attached to and extends upwardly from the first lateral edge 24, a second side wall 30 is attached to and extends upwardly from the second lateral edge 26, and a rear wall 32 is attached to and extends upwardly from the rear edge 22. The plate 14 may have a length from the front edge 20 to the rear edge 22 between 8.0 inches 16.0 inches and width from the first lateral edge 24 to the second lateral edge 26 being less than 6.0 inches. The first side wall 28, second side wall 30 and rear wall 32 each have a height less than 4.0 inches.

A bracket 34 is attached to the base 12 and the bracket 34 is configured to couple the base 12 to a tree stand 70. More particularly, the bracket 34 may retain the plate 14 in a horizontal orientation. The bracket 34 includes a pair of arms 36 attached to the plate 14 and extending laterally away from the first lateral edge 24. A pair of panels 38 and a pair of fasteners 40 is provided. Each of the fasteners 40 is attached to and extends through one of the arms 36 and one of the panels 38. The fasteners 40 move the panels 38 toward or away from the arms 36 when the fasteners 40 are actuated. The fasteners 40 may be threadably coupled to the panels 38 and/or the arms 36 to move them toward or away from each other as the fasteners 40 are rotated. It should be understood that the bracket 34 may include a single panel 38 attached to each of the arms 36. The panels 38 may have apertures 42 extending therethrough for tie-down capability.

A post 44 has a first end 46 and a second end 48 with the first end 46 being pivotally coupled to the base 12. The post 44 is positionable between a deployed position extending upwardly from the base 12 or in a stored position lying on the base 12. The post 44 may be pivotally coupled to the first lateral wall 28 adjacent to the front edge 20. The rear wall 32 may have a notch 50 therein for receiving the post 44 when the post 44 is in the stored position. The post 44 has length from the first end 46 to the second end 48 greater than a length of plate 14 and may have length up to 24.0 inches. As is shown in the Figures, a stop 52 may be provided between the first end 46 and the front edge 20 to allow the post 44 to rest thereon to form an obtuse angle between the second end 48, first end 46 and rear edge 22 to facilitate retention of the post 44 in the deployed positioned.

A gun holder 54 is attached to the post 44 adjacent to the second end 48. The gun holder 54 is directed rearward from the post 44 when the post 44 is in the deployed position. The gun holder 54 may be U-shaped and may further be coated with a resiliently compressible material to prevent marring of a firearm. The gun holder 54 is particularly adapted for supporting elongated guns 72 including a rifle or a shot gun. A bow holder 56 is attached to the post 44 adjacent to the second end 48 and extends laterally away from the post 44 over the second lateral edge 26. The bow holder 56 may also be U-shaped as shown in the Figures with its ends 58 being slightly arced toward each other to prevent a bow 74 from sliding laterally away from the bow holder 56. The bow holder 56 may also be coated in a resiliently compressible material. The bow holder 56 may be rotatable with respect to the post 44 to allow a person to adjust it as needed.

In use, the base 12 is attached to a conventional tree stand 70 used for hunting. The plate 14 provides a support for the post 44 and for the butt of the gun 72. The gun holder 54 provides a cradle to retain the gun 72 in an upright position so that it is easily gripped and manipulated into proper firing position should game be spotted. The bow holder 56 likewise retains the bow 74 in an upright position to allow for quickly gripping and utilizing the bow 74 as needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A weapon support assembly configured for engaging a tree stand, said assembly comprising:

a base, said base having a front edge and a rear edge;

a bracket being attached to said base, said bracket being configured to couple said base to a tree stand;

a post having a first end and a second end, said first end being pivotally coupled to said base, said post being positionable between a deployed position extending upwardly from said base or in a stored position lying on said base, said first end being positioned nearer to said front edge than said rear edge, an obtuse angle being formed between said post and said base as taken from said rear edge to said second end of said post when said post is in said deployed position, said post being angled toward said front edge when said post is in said deployed position; and a gun holder being attached to said post adjacent to said second end.

2. The weapon support assembly according to claim 1, wherein said base includes:

a plate having a top side, a bottom side, a front edge, a rear edge, a first lateral edge and a second lateral edge, said plate being elongated from said front edge to said rear edge;

a first side wall being attached to and extending upwardly from said first lateral edge, a second side wall being attached to and extending upwardly from said second lateral edge, said first and second side walls extending from said rear edge to a position adjacent to said post to inhibit a weapon from moving laterally off of said base; and a rear wall being attached to and extending upwardly from said rear edge.

3. The weapon support assembly according to claim 2, wherein said bracket includes:

a pair of arms being attached to said plate and extending laterally away from said first lateral edge;

a pair of panels; and a pair of fasteners, each of said fasteners being attached to and extending through one of said arms and one of said panels, said fasteners moving said panels toward or away from said arms when said fasteners are actuated.

4. The weapon support assembly according to claim 2, wherein said post is pivotally coupled to said first side wall adjacent to said front edge.

5. The weapon support assembly according to claim 2, wherein said gun holder is directed rearward from said post when said post is in said deployed position.

6. The weapon support assembly according to claim 5, further including a bow holder being attached to said post adjacent to said second end and extending laterally away from said post over said second lateral edge.

7. The weapon support assembly according to claim 2, wherein said rear wall has a notch therein for receiving said post when said post is in said stored position.

8. A weapon support assembly configured for engaging a tree stand, said assembly comprising:

a base, said base including;

a plate having a top side, a bottom side, a front edge, a rear edge, a first lateral edge and a second lateral edge, said plate being elongated from said front edge to said rear edge;

a first side wall being attached to and extending upwardly from said first lateral edge, a second side wall being attached to and extending upwardly from said second lateral edge;

a rear wall being attached to and extending upwardly from said rear edge;

a bracket being attached to said base, said bracket being configured to couple said base to a tree stand, said bracket including;

a pair of arms being attached to said plate and extending laterally away from said first lateral edge;

a pair of panels;

a pair of fasteners, each of said fasteners being attached to and extending through one of said arms and one of said panels, said fasteners moving said panels toward or away from said arms when said fasteners are actuated;

a post having a first end and a second end, said first end being pivotally coupled to said base, said post being positionable between a deployed position extending upwardly from said base or in a stored position lying on said base, said post being pivotally coupled to said first side wall adjacent to said front edge, said first end being positioned nearer to said front edge than said rear edge, an obtuse angle being formed between said post and said base as taken from said rear edge to said second end of said post when said post is in said deployed position, said post being angled toward said front edge when said post is in said deployed position;

a gun holder being attached to said post adjacent to said second end, said gun holder being directed rearward from said post when said post is in said deployed position, said gun holder being U-shaped;

a bow holder being attached to said post adjacent to said second end and extending laterally away from said post over said second lateral edge; and said rear wall having a notch therein for receiving said post when said post is in said stored position.

9. The weapon support assembly according to claim 8, further including a stop being attached to and extending upwardly from said base, said stop being positioned between said front edge and said first end of said post, said post resting upon said stop when said post is in said deployed position.

10. The weapon support assembly according to claim 1, further including a stop being attached to and extending upwardly from said base, said stop being positioned between said front edge and said first end of said post, said post resting upon said stop when said post is in said deployed position.

* * * * *